US005151016A

United States Patent [19]

Her

[11] Patent Number: 5,151,016

[45] Date of Patent: Sep. 29, 1992

[54] LIQUID PUMP RESPONSIVE TO TEMPERATURE

[76] Inventor: Tser W. Her, No. 16, Lane 946, Mintsu 1 Rd., Tsoying Dist., Kaohsiung, Taiwan

[21] Appl. No.: 802,512

[22] Filed: Dec. 5, 1991

[51] Int. Cl.[5] ..... F04D 15/00; F04D 29/58

[52] U.S. Cl. ..... 417/32; 417/366; 417/372; 417/423.7; 417/423.11; 417/423.12; 417/423.14

[58] Field of Search ..... 417/32, 366, 372, 423.1, 417/423.7, 423.11, 423.12, 423.14

[56] References Cited

U.S. PATENT DOCUMENTS 3,911,943 10/1975 Athey et al. ..... 417/32

4,013,383 3/1977 Rule ..... 417/423.14

5,040,950 8/1991 Dalquist, III et al. ..... 417/366

*Primary Examiner*—Richard A. Bertsch

*Assistant Examiner*—David W. Scheuermann

*Attorney, Agent, or Firm*—Fleit, Jacobson, Cohn, Price, Holman & Stern

[57] ABSTRACT

A liquid pump comprising a motor sealed up in an inner cylindrical housing and cooled off by a liquid flowing in and out of a liquid cooling room formed by the cylindrical walls of the inner cylindrical housing and an outer cylindrical housing, and a liquid sensor serving to control the power of the motor by means of a resistance alteration of a temperature sensing means in the liquid sensor.

6 Claims, 3 Drawing Sheets

LIQUID PUMP RESPONSIVE TO TEMPERATURE

BACKGROUND OF THE INVENTION

A conventional liquid pump usually comprises a motor and a pump combined together to have a common shaft, and the housing of the motor and the pump base are made of cast iron. The motor is cooled by a fan fixed on its shaft and a fan of the pump is cooled by liquid in the pump. But if the liquid is stopped to supply to the pump, the pump fan and the motor are liable to burn up because of continuous operation. Three methods are used in a conventional liquid pump to prevent such an occasion from happening.

One method is to provide a temperature switch for the coil of the motor to cut off automatically electric power in case of the temperature of the coil exceeding a pre-set value, and to turn on once the temperature of the coil drops below the pre-set value. This protective way performed by the temperature switch cannot fully operate its function before the pump continues to operate for 15–30 minutes, so the insulation of the coil can be easily imparted and the pump fan can also be broken.

Another method is to provide at the entrance of the liquid a pressure valve comprising a metal resilient piece for sensing the pressure of the liquid. But if the liquid is supplied and stopped irregularly and alternately, the motor can also operate and stop in the same way, not good for the motor. In addition, the metal resilient piece may be adhered with miscellaneous material in the liquid to reduce its effectiveness.

The last method is to control operation of the motor by means of the difference of the current of the motor between loaded condition and unloaded condition so that the motor is turned off in case of no load. But the motor has to be turned on manually, unable to be turned on automatically, when the liquid begins to supply again.

SUMMARY OF THE INVENTION

This invention has been devised to improve the disadvantage of conventional liquid pumps described above, and planned to have several advantageous features list below.

1. The motor in this pump can be prevented from high temperature caused by rotation for a long period of time, cooled off by low temperature of the liquid circulating in and out of a liquid cooling room provided in this pump.

2. A liquid sensor used in this pump can prevent the motor from operating under no load for a long period of time, and resultant burning caused by high temperature can be avoided.

3. The liquid sensor can also start the motor again in case the liquid cooling room receives liquid again.

4. The liquid sensor can also sense out whether the liquid is temporarily stopped or mixed with air, preventing the motor from irregular operation repeatedly on-and-off rotation.

DETAILED DESCRIPTION OF THE INVENTION

Figure 1:
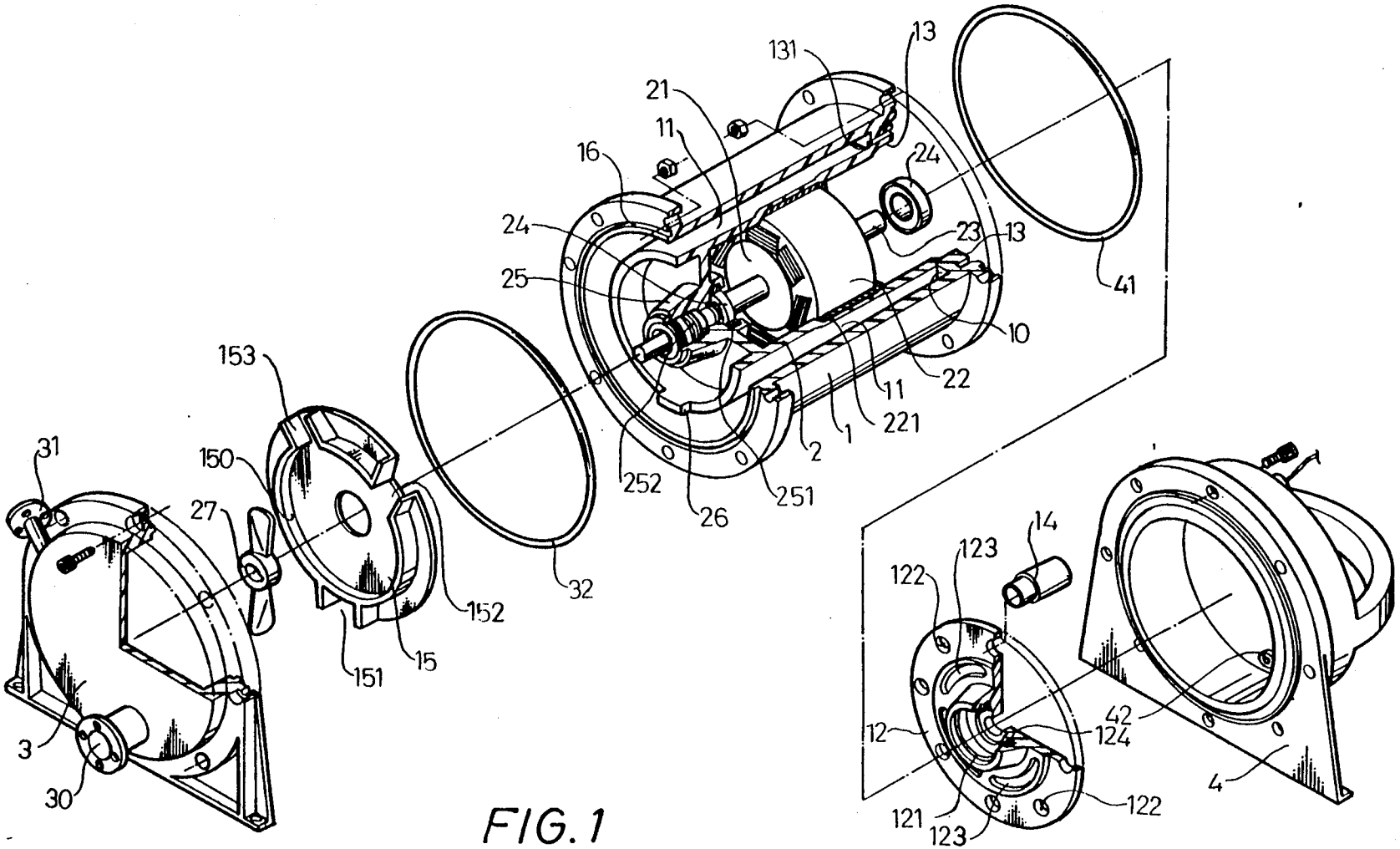
FIG. 1 is an exploded perspective view of the liquid pump in the present invention.
Figure 3:
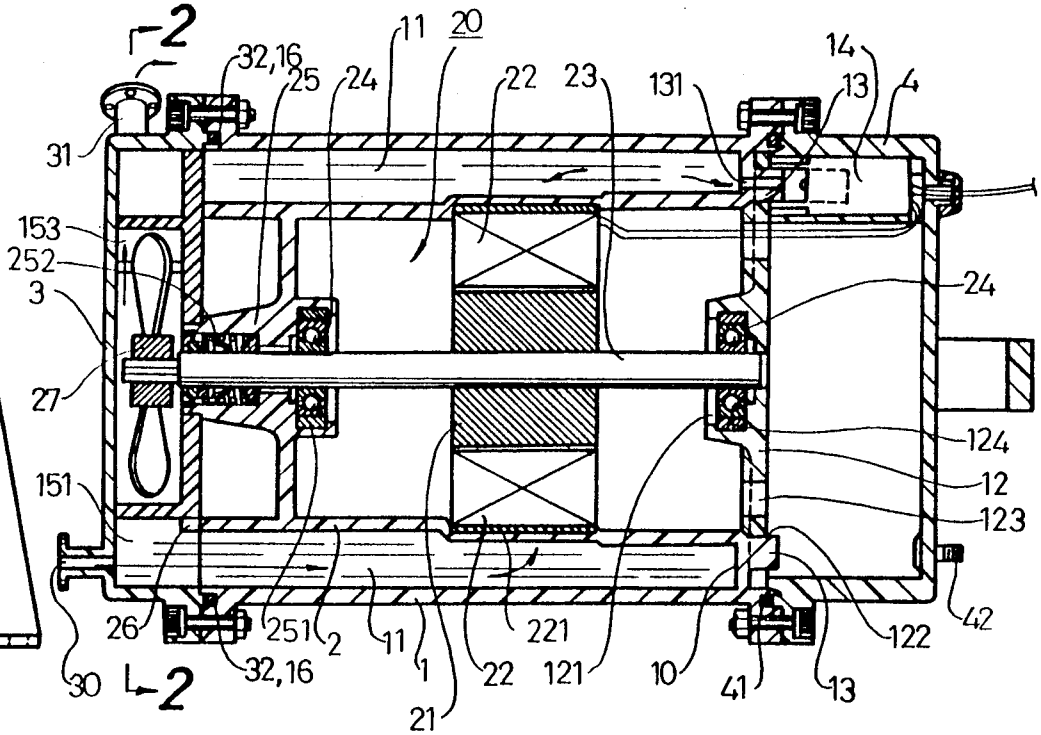
FIG. 3 is a cross-sectional view of the liquid pump in the present invention.

The liquid pump in the present invention, as shown in FIG. 3, comprises an outer housing 1, an inner housing 2, a left cap 3, a right cap 4, an intermediate cap 12, a sealing disc 15, a liquid sensor 14, and a motor as the main components.

The outer housing 1 is a cylinder having two flanges at two lengthwise ends to combine with the right cap 4 and the left cap 3. The outer housing 1 is made together with the inner housing 2 as one unit by means of an injecting molding process.

The inner housing 2 is also a cylinder made of high heat-enduring plastic and positioned inside the outer housing 1 to have a common axis, and an annular bottom wall 10 is formed between the right side edge of the inner housing 2 and the right side edge of the outer housing 1. Then an annular liquid cooling room 11 is formed surrounded by the cylindrical wall of the outer housing 1 and of the inner housing 2 and the annular bottom wall 10 as its three side walls. The inner housing 2 also has a metal cylinder 221 around its inner surface to contain the motor in its interior, and the motor has a rotor 21, a stator 22 fixed inside a metal cylinder 221 and a shaft 23 which is pushed in a bearing 24 fixed in a copper ring 251 of a shaft supporter 25 and in a copper ring 124 of a shaft supporter 121 in an intermediate cap 12 so as to let the motor rotate and be protected from the liquid in the room 11 to leak into the inner housing 2.

The annular bottom wall 10 serves as the third sealing wall together with the first (the cylindrical wall of the outer housing) and the second (the cylindrical wall of the inner housing) sealing wall of the liquid cooling room 11. The annular bottom wall 10 has two opposite posts 13 projecting outward to insert in two opposite holes 122 in the intermediate cap 12 to position firmly said cap 12. The upper one of the post 13 has a central through hole 131 communicating with the liquid cooling room 11 and a sensing means 140 of a liquid sensor 14 is inserted and sealed in the through hole 131 to sense out directly if there is liquid in the cooling room 11.

The intermediate cap 12 is combined with the right side of the inner housing 2 by means of the posts 13 and the holes 122 to close up said right side, having a central shaft supporter 121 provided with a copper ring 124 for fixing a bearing 24 to support the shaft 23 of the motor and several curved slots 123 for air to flow in and out of the interior of the inner housing 2 and for lead wires to go through.

The sealing disc 15 is provided to close up the left sides of the inner housing 2 and the outer housing 1, having an opening 151 at the lower edge for a rectangular projection 26 of the inner housing to engage therein so as to position firmly said disc 15 to reduce eccentric rotation of the shaft 23. The sealing disc 15 also seals up the left annular opening of the liquid cooling room 11, functioning as the fourth sealing wall of said room 11. Said disc 15 also has an annular wall 150 projecting from the outer surface for dividing the space between the sealing disc 15 and the left cap 3 into a central one and a circular one outside the wall 150, and the opening 151 is provided below the bottom edge of the wall 150 for the rectangular projection 26 to stick therein, and through said opening 151 the liquid coming through an inlet 30 in the left cap 3 flows in the room 11. Said disc 15 also has an opening 152 through the wall 150 for the liquid in said room 11 to flow in the central space surrounded by the wall 150 and to be driven by a fan 27 so as to flow out of an outlet 31 in the left cap 3 via an outlet 153 in the sealing disc 15.

The left cap 3 is adapted to close up the left side of the outer housing 1 and an anti-leak gasket 32 is interposed between said cap 3 and the sealing disc 15 so that the sealing disc 15 can tightly close up the left side of the inner housing 2. Then a pumping room is formed between the left cap 3 and the sealing disc 15 and therein is located the fan 27 fixed on the end of the motor, which rotates the fan 27 to drive out the liquid in the room 11. A conventional sealer 252 is provided on the shaft 23 to prevent liquid from leaking in the motor. The left cap 3 has an inlet 30 and an outlet 31 for liquid to flow in to fill up the room 11, then to pass through the passage 152 to flow into the pumping room between said cap 3 and said sealing disc 15, and finally to flow out of the outlet 31 by means of the fan 27.

The right cap 4 is provided to close up the right side of the outer housing 1, with an antileak gasket 41 and the intermediate cap 12 sandwiched between them 4 and 1 so that a pressure room is formed between the right cap 4 and the intermediate cap 12. A valve 42 is formed in the right cap 4 for air to be sucked through into the interior of the inner housing 2 via the curved holes 123 in the intermediate cap 12 so that whether there is any leakage between the inner housing 2, the liquid room 11 and sealing disc 15 can be tested by putting the motor in water.

Figure 2:
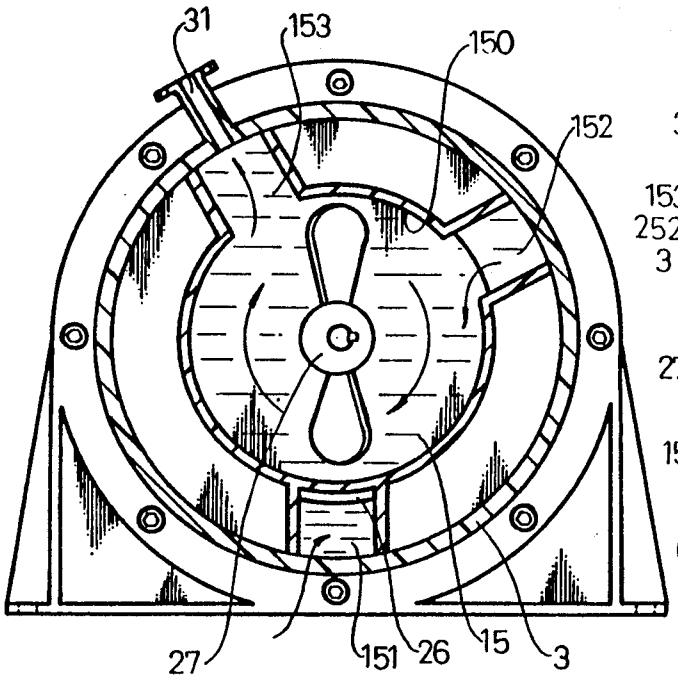
FIG. 2 is a cross-sectional view of line 2—2 in FIG. 3.

Next, with reference to FIGS. 2 and 3, how liquid in the pump flows is to be described. Liquid is made to flow through the inlet 30 in the left cap 3, then into the liquid cooling room 11, through the passage 152 into the pumping room between the sealing disc 15 and the left cap 3, and finally to go out of an outlet 31 forced by the fan 27. During flowing movement of the liquid, the liquid sensor 14 provided on the intermediate cap 12 can sense out the temperature of the liquid or that of no liquid in the room 11 by means of a sensing means i.e. a thermistor 140, which can change its own resistance in accordance with the temperature it senses out, starting a relay 141 in the sensor 14 so that the motor can be automatically turned on or off.

Figure 4:
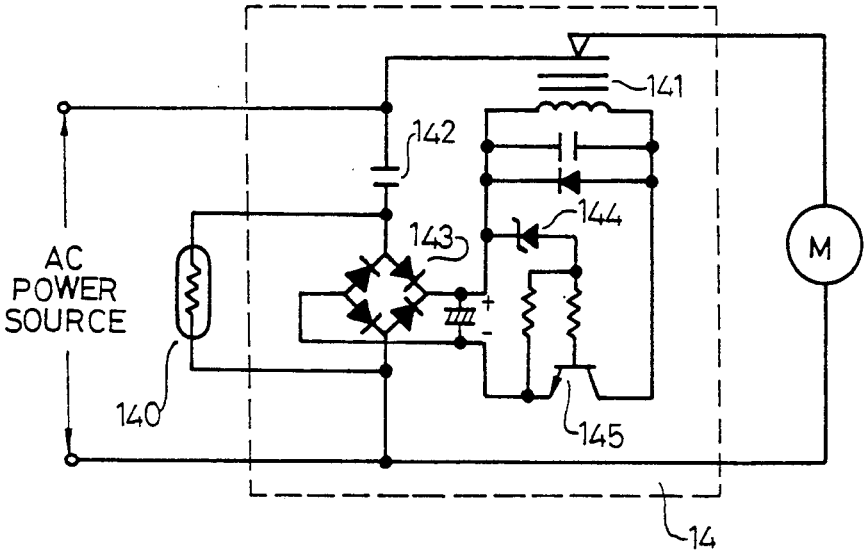
FIG. 4 is a diagram of the electric circuit for the liquid sensor in the present invention.

The electric circuit of the liquid sensor 14 is shown in FIG. 4, including a condensor 142 to reduce the voltage of the power source, which then is fed to a bridge rectifier 143 having its alternate current terminal connected in parallel with the sensing means 140 in the liquid sensor 14. When liquid is flowing in the room 11, the thermistor 140 can sense out a comparatively low temperature of the liquid, and consequently to raise up the resistance value of its own so that the current passing through the bridge rectifier 143 can be increased, and the output voltage also becomes high. Then a Zenner diode 144 becomes ON, actuating a transistor 145 to make the relay 141 magnetized to function to start the motor, which in turn rotates the fan 27 to pump the liquid. In case the room 11 becomes empty for a long period of time, the thermistor 140 reduces its resistance value according to the increasing temperature, and thus the current passing through the rectifier 143 can also reduce largely. Then the voltage at the output terminal of the rectifier 143 correspondingly drops down to turn off the Zenner diode 144, the transistor 145 and finally the relay 141, stopping the power of the motor. Thus the motor can be prevented from burning caused by operating under no load for a long time. But if liquid is again supplied into the room 11, the motor can be started again by the function of the thermistor 140 and of the relay 141.

Now, supposing that the liquid in the room 11 should be instantly ceased to flow therein or mixed with air, the thermistor 140 would gradually be reduced of its resistance value, not immediately actuating to cut off the power of the motor, preventing it from irregular operation i.e. repeated on-and-off rotation.

What is claimed is:

1. A liquid pump comprising;

an outer housing made together with an inner housing by means of injecting molding, having a cylindrical shape with a flange at both longitudinal sides to combine with a right cap and a left cap by means of bolts and nuts;

an inner housing of a cylindrical shape diametrically smaller than the outer housing to be axially fixed in the outer housing, having a metal cylinder inside for containing a motor consisting of a rotor, a stator and a shaft in its interior, and having its right side sealed up with an intermediate cap and its left side sealed up with a sealing disc;

an intermediate cap sealing up the right side of the inner housing, having a central shaft supporter with a copper ring for a bearing to fit in to support the motor shaft also supported in a bearing fitted in a copper ring of a shaft supporter of the inner housing, several curved slots for air to flow in and out of the inner housing, being sealed up by a right cap combined with the outer housing, and forming a pressure room with the right cap;

a liquid cooling room surrounded by the longitudinal walls of the inner and the outer housing, an annular bottom wall formed between the right side edges of both the inner and the outer housing and a sealing disc, the cooling room being for the liquid pumped by this pump to circulate therein to cool a motor contained in the inner housing;

a sealing disc sealing up the left side of the inner and the outer housing, having a central hole for the motor shaft to extend out for a fan to be fixed on the shaft end, an annular wall extending sidewise out of the outer surface, an opening just under the bottom portion of the annular wall, said opening being inserted by a projection extending out of the left side wall of the inner housing, and said annular wall having a passage;

a right cap combined with the right side flange of the outer housing, forming a pressure room with the intermediate cap; and a left cap combined with the left side flange of the outer housing, defining a pumping room together with the sealing disc, said pumping room having the fan therein to rotate to push the liquid coming through an inlet in the left cap, then through the opening in the sealing disc into the liquid cooling room via the passage into the pumping room to flow out of an outlet in the left cap.

2. The liquid pump as claimed in claim 1, wherein the metal cylinder provided inside the inner housing is made of stainless steel having excellent heat conductivity and anti-rusting.

3. The liquid pump as claimed in claim 1, wherein the liquid cooling room is provided with a through hole, in which a sensing means in a liquid sensor can extend.

4. The liquid pump as claimed in claim 1, wherein the right cap is provided with a valve, through which air can be made to flow into the pressure room and then through air passages provided in the intermediate cap into the interior of the inner housing.

5. The liquid pump as claimed in claim 1, wherein the liquid sensor includes a temperature sensing means which can change the resistance value of its own in accordance with the temperature of the liquid therein or of no liquid therein, actuating a relay via a Zenner diode and a transistor so that the motor can continue to operate when the liquid is supplied to flow continuously or only instantly stopped to flow, but the motor can be stopped by cutting off the power when the liquid is not supplied to flow therein for a long period of time.

6. The liquid pump as claimed in claim 1, wherein the temperature sensing means is a thermistor.

* * * * *